US008678211B1

(12) United States Patent
Lin

(10) Patent No.: US 8,678,211 B1
(45) Date of Patent: Mar. 25, 2014

(54) PRESSED DOUBLE LAYER LIP HYDRATION BOTTLE

(71) Applicant: Shin-Shuoh Lin, Laguna Hills, CA (US)

(72) Inventor: Shin-Shuoh Lin, Laguna Hills, CA (US)

( * ) Notice: Subject to any disclaimer, the term of this patent is extended or adjusted under 35 U.S.C. 154(b) by 0 days.

(21) Appl. No.: 13/694,046

(22) Filed: Oct. 24, 2012

(51) Int. Cl.
*B65D 1/46* (2006.01)

(52) U.S. Cl.
USPC ..... 215/42; 215/12.1; 215/355

(58) Field of Classification Search
USPC ..... 215/12.1, 12.2, 42, 355, 356
See application file for complete search history.

(56) References Cited

U.S. PATENT DOCUMENTS

| | | | | | |
|---|---|---|---|---|---|
| 302,268 | A | * | 7/1884 | Lothrop | 215/42 |
| 1,409,336 | A | * | 3/1922 | Fahlman | 220/642 |
| 1,415,908 | A | * | 5/1922 | Tofting | 215/231 |
| 1,952,401 | A | * | 3/1934 | Wilson | 229/5.5 |
| 2,108,583 | A | | 2/1938 | Falk | |
| 2,116,199 | A | * | 5/1938 | Held | 228/154 |
| 2,144,820 | A | | 1/1939 | Thomas | |
| 2,376,909 | A | * | 5/1945 | Ford | 215/42 |
| 2,390,721 | A | * | 12/1945 | Mallgraf | 215/334 |
| 2,871,130 | A | * | 1/1959 | Holman | 426/115 |
| 3,164,287 | A | * | 1/1965 | Williamson | 220/288 |
| 3,177,502 | A | * | 4/1965 | Meunier | 4/227.5 |
| 3,343,579 | A | * | 9/1967 | Clark | 383/80 |
| 3,603,472 | A | * | 9/1971 | Lecinski et al. | 215/253 |
| 3,787,547 | A | * | 1/1974 | Stephan | 264/249 |
| 3,899,096 | A | * | 8/1975 | Marco | 215/42 |
| 3,905,509 | A | * | 9/1975 | Markowitz | 220/319 |
| 4,044,917 | A | * | 8/1977 | Vella | 220/288 |
| 4,316,318 | A | * | 2/1982 | Mineo | 29/512 |
| 4,472,219 | A | * | 9/1984 | Taira et al. | 156/69 |
| 4,560,566 | A | * | 12/1985 | Roth | 426/399 |
| 4,607,757 | A | * | 8/1986 | Lecinski | 215/246 |
| 4,700,859 | A | | 10/1987 | Gregory | |
| 4,844,270 | A | * | 7/1989 | Coffman | 215/274 |
| 4,856,174 | A | * | 8/1989 | Ishizaki et al. | 29/455.1 |
| 5,156,284 | A | * | 10/1992 | del Pilar Pla Rodriguez et al. | 215/11.6 |
| 5,588,544 | A | * | 12/1996 | Takashima et al. | 215/42 |
| 5,678,711 | A | * | 10/1997 | Tobias | 215/42 |
| 5,778,723 | A | * | 7/1998 | Diekhoff | 72/356 |
| 5,785,198 | A | * | 7/1998 | Credle, Jr. | 220/254.8 |
| 5,822,843 | A | * | 10/1998 | Diekhoff et al. | 29/512 |
| 5,884,786 | A | * | 3/1999 | Valyi | 215/44 |
| 6,010,026 | A | * | 1/2000 | Diekhoff et al. | 220/288 |
| 6,102,225 | A | * | 8/2000 | Lynn | 215/252 |
| 6,105,807 | A | * | 8/2000 | McCrossen | 220/288 |
| 6,375,020 | B1 | * | 4/2002 | Marquez | 215/232 |
| 6,543,636 | B1 | * | 4/2003 | Flecheux et al. | 220/288 |
| 6,736,295 | B2 | | 5/2004 | Lin | |
| 6,779,677 | B2 | * | 8/2004 | Chupak | 220/288 |
| D501,362 | S | | 2/2005 | Gauss | |

(Continued)

*Primary Examiner* — Anthony Stashick
*Assistant Examiner* — Christopher McKinley
(74) *Attorney, Agent, or Firm* — Gordon K. Anderson

(57) ABSTRACT

A pressed double layer lip hydration bottle is taught that incorporates a single wall stainless steel cylindrical body having an enclosed bottom, an open top, and a reduced diameter neck. The neck includes formed threads which protrude inwardly within the neck, A stainless steel ferrule is tightly fitted onto the outside surface of the neck. A top weld bead joins the bottle neck to the ferrule forming a smooth joint, with the weld bead having a ground smooth and polished surface eliminating all irregularities and sharp edges permitting a liquid to be sipped from the bottle comfortably. A bottom weld bead joins the bottom of the ferrule to the bottle forming a homogenous juncture creating a hermetic seal between the ferrule and the bottle preventing entry of foreign matter and growth of any microorganism's therebetween.

4 Claims, 4 Drawing Sheets

(56) References Cited

U.S. PATENT DOCUMENTS

| | | | | |
|---|---|---|---|---|
| 6,907,653 | B2 * | 6/2005 | Chupak | 29/512 |
| D509,408 | S | 9/2005 | Ward et al. | |
| 7,014,060 | B2 * | 3/2006 | Richardson | 220/288 |
| D574,156 | S | 8/2008 | Davis et al. | |
| D574,242 | S | 8/2008 | Lin | |
| D574,243 | S | 8/2008 | Lin | |
| D574,244 | S | 8/2008 | Lin | |
| D591,108 | S | 4/2009 | Pesach et al. | |
| D592,913 | S | 5/2009 | Pinelli et al. | |
| 7,946,436 | B2 * | 5/2011 | Laveault et al. | 215/42 |
| 7,980,403 | B2 * | 7/2011 | Martinez | 215/356 |
| 2001/0040167 | A1 * | 11/2001 | Flecheux et al. | 220/634 |
| 2002/0079280 | A1 | 6/2002 | Neuner | |
| 2003/0057173 | A1 * | 3/2003 | Wagner | 215/44 |
| 2004/0035871 | A1 * | 2/2004 | Chupak | 220/608 |
| 2007/0090078 | A1 * | 4/2007 | Laveault et al. | 215/12.2 |
| 2008/0174102 | A1 | 7/2008 | McKinnon et al. | |
| 2009/0301990 | A1 | 12/2009 | Cresswell et al. | |

* cited by examiner

PRESSED DOUBLE LAYER LIP HYDRATION BOTTLE

CROSS REFERENCE TO RELATED APPLICATION

This application is a Continuation-in-Part of patent application Ser. No. 12/459,209 filed Jun. 29, 2009.

TECHNICAL FIELD

The present invention relates to liquid containing bottles in general. More specifically to single wall stainless steel bottle having a double layer lip.

BACKGROUND OF THE INVENTION

Previously, many styles, shapes and forms of water bottles have been used in endeavoring to provide an attractive and convenient means for carrying water or other liquids for human consumption.

The prior art listed below did not disclose patents that possess any of the novelty of the instant invention; however the following U.S. patents are considered related:

| Pat. No. | Inventor | Issue Date |
|---|---|---|
| 2,108,583 | Falk | Feb.15, 1938 |
| 2,144,820 | Thomas | Jan. 24, 1939 |
| 4,700,859 | Gregory | Oct. 10, 1987 |
| 6,736,295 | Lin | May 18, 2004 |
| D592,913 S | Pinelli et al. | May 26, 2009 |
| D591,108 S | Pesach et al. | Apr. 28, 2009 |
| D574,156 S | Lin | Aug. 19, 2008 |
| D574,244 S | Lin | Aug. 5, 2008 |
| D574,243 S | Lin | Aug. 5, 2008 |
| D574,242 S | Lin | Aug. 5, 2008 |
| D509,408 S | Ward et al. | Sep. 13, 2005 |
| D501,362 S | Gauss | Feb. 1, 2005 |
| **Patent Application Publication No.** | | |
| 2002/0079280 A1 | Neuner | Jun. 27, 2002 |
| 2008/0174102 A1 | McKinnon et al. | Jul. 24, 2008 |
| 2009/0301990 A1 | Cresswell et al. | Dec. 10, 2009 |

The above referenced design patents represent the diversity of shapes that bottles for containing liquids may possess, and yet still have the same basic utility. The patents designated above issued to Lin, are my previous designs protected by granted patents. The following shapes illustrate some of my favored configurations for the hydration bottle as follows;

U.S. Pat. No. D574,244 S illustrating a bottle having a tapered waist shape;

U.S. Pat. No. D574,243 S illustrating a bottle having a slender neck shape;

U.S. Pat. No. D574,242 S illustrating a bottle having a slim waist shape, and;

U.S. Pat. No. D574,156 S illustrating a bottle having a dumbbell shape.

Thomas in U.S. Pat. No. 2,144,820 teaches a double walled vacuum receptacle having a pair of spaced nested cylinders of metal welded together at the top by a strong glass seal effectively heat insulated from the outer metal cylinder which forms at a portion of the outer casing. The inner casing is metal and is inserted into the outer casing prior to spinning the outer casing neck.

U.S. Pat. No. 6,736,295 issued to Lin is my previous patent for a vacuum insulated high flow carafe having a body with a mounting ring which includes a pouring spout and stopper containing external male threads.

U.S. patent application publication No. 2002/0079280 A1 of Neuner discloses a container made from a vial-like mass produce bottle with a separately molded plastic neck mounted securely on the bottle. The neck is secured to the bottle with a ferrule and a seal with the aluminum ferrule pressed over the neck. The ferrule is press fit over the resilient sleeve of the plastic neck insert to lock into the flange.

The remainder of the patents listed are indicative to the structure and designs taught in the prior art.

BRIEF SUMMARY OF THE INVENTION

One of the problems with current single wall metallic water bottles is that in order to provide comfort for the user when drinking a liquid from the metal open top, is that the upper surface is rather thin and requires some type of lip at the top wide enough to prevent discomfort to the user from any sharpness. Prior art has attempted to overcome this difficulty by using two separate methods, with the first providing a roll-out lip which is made by rolling the top edge of the bottle over the top in a full radius until the edge touches the neck. The second method adds an aluminum threaded insert inside the neck with the bottom interfacing with a formed bead at the base of the neck and the top secured with a rolled-in lip sandwiching the insert into the neck.

However, the above attempt to satisfy the sharpness creates another difficulty or potential problem. When a raw edge is rolled either outwardly or inwardly there is a minute crack or space which could be infinitesimal, however moisture may enter into this space and remain even after washing and drying. This crack or space creates a hygienic problem related to this particular design aspect which could be hazardous to ones health. Microorganisms that are present in the environment may find a media that retains or even propagates growth of bacteria, fungus spores and viruses. Proper cleaning minimizes this possibility however in many cases the bottle is used principally for water therefore thorough cleaning with soap and hot water is not always possible or even by some thought to be unnecessary.

The primary object of the invention is to maintain hygienic properties by eliminating any crack or space that comes in contact with a person or the liquid within the bottle. This feature is accomplished by forming the necessary threads for a cap of cover in the neck itself and then utilizing a stainless steel ferrule on the outside pressed onto the neck with the top and bottom sealed with a weld bead. The weld bead on the top is then ground and polished to create a smooth undetected surface.

An important object of the invention is in the use of stainless steel as the basic material as its properties are ideal for the application. Stainless steel is strong, durable and compatible with water. Type 18/8, in the food grade, is ideal for the application and may be finished on the inside by polishing and on the outside with a smooth or brushed finish. A baked enamel finish may also be applied of various colors and hues.

While plastic water bottles are also currently used for hydration purposes there is a potential problem if the plastic formulation utilizes a polycarbonate material. It has been found by environmental researchers that polycarbonate leaches dangerous levels of bisphenol A (BPA), a synthetic chemical that mimic's natural hormones can send bodily processes into disarray. This fact alone is sufficient to make the use of stainless steel a more viable material for the purpose.

Another object of the invention is that there are no threads or seams visible from the outside as the ferrule is smooth and flat, or even stepped, to correspond with the outside surface shape of the bottle. The threads are hidden and the outside is configured to clean easily and produce an attractive appearance Still another object of the invention is that the drinking lip large enough for comfort and permits a number of ice cubes to be easily inserted simultaneously into the top whereas some prior art bottles have a small neck disallowing this utility.

Yet another object of the invention permits the use of a variety of threaded caps, stoppers and lids to be used which are limited only by a compatible size and thread configuration.

A final object of the invention overcomes a possible corrosion problem created where some prior art uses the rolled-in lip methods in conjunction with an aluminum threaded insert. When using the above method, the combination of the aluminum and stainless steel material, when nested together without any protection, are classified as dissimilar metals which have the propensity to cause electrolytic corrosion. In the case of a bottle containing water and also washed or cleaned in water any trapped moisture could to result in the corrosion leaking from the microscopic gaps at the interface with the raw edges that touch against each other, as described previously.

These and other objects and advantages of the present invention will become apparent from the subsequent detailed description of the preferred embodiment and the appended claims taken in conjunction with the accompanying drawings.

DETAILED DESCRIPTION OF THE INVENTION

Figure 1:
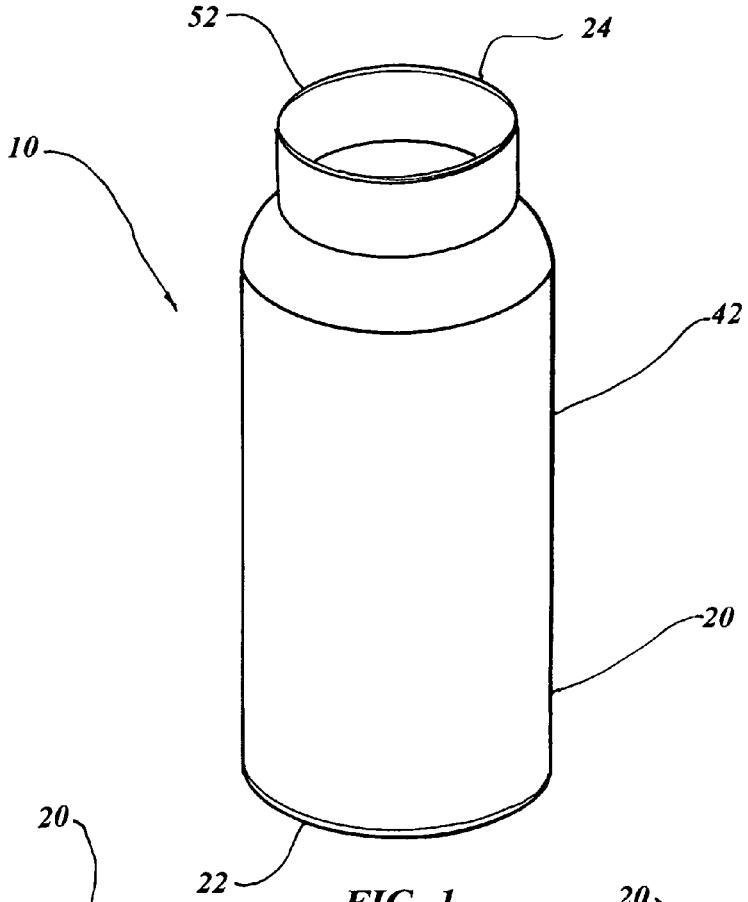
FIG. 1 is a partial isometric view of the hydration bottle in the preferred embodiment.
Figure 2:
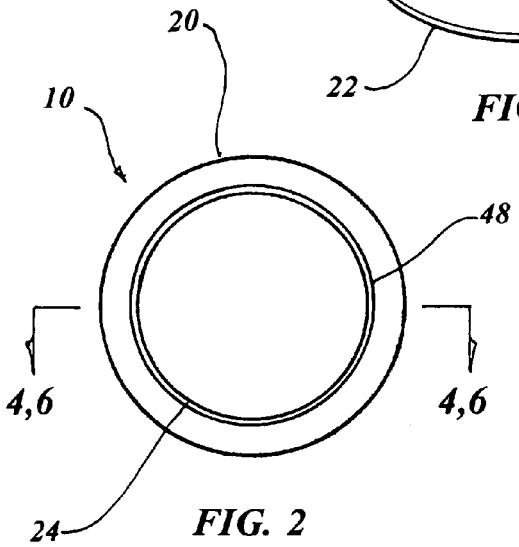
FIG. 2 top plan view of the hydration bottle in the preferred embodiment.
Figure 3:
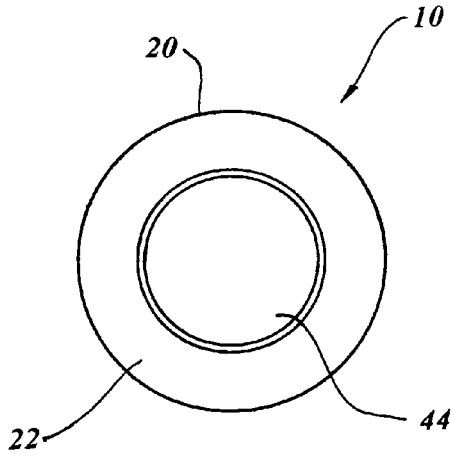
FIG. 3 is a bottom view of the hydration bottle in the preferred embodiment.

The best mode for carrying out the invention is presented in terms of a preferred embodiment. This preferred embodiment of a pressed double layer lip hydration bottle 10 is shown in FIGS. 1 thorough 14 and is comprised of a single wall stainless steel cylindrical body 20 having an enclosed bottom 22 and an open top 24.

Figure 4:
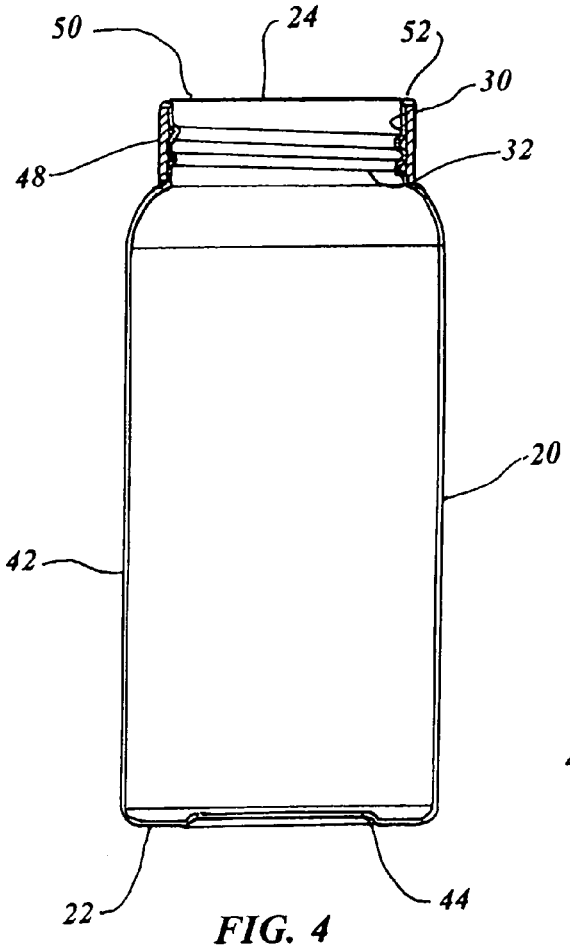
FIG. 4 is a cross sectional view taken along lines 4-4 of FIG. 2 illustrating the entire hydration bottle cross section.
Figure 4A:
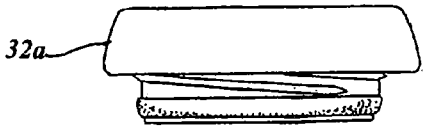
Figure 6:
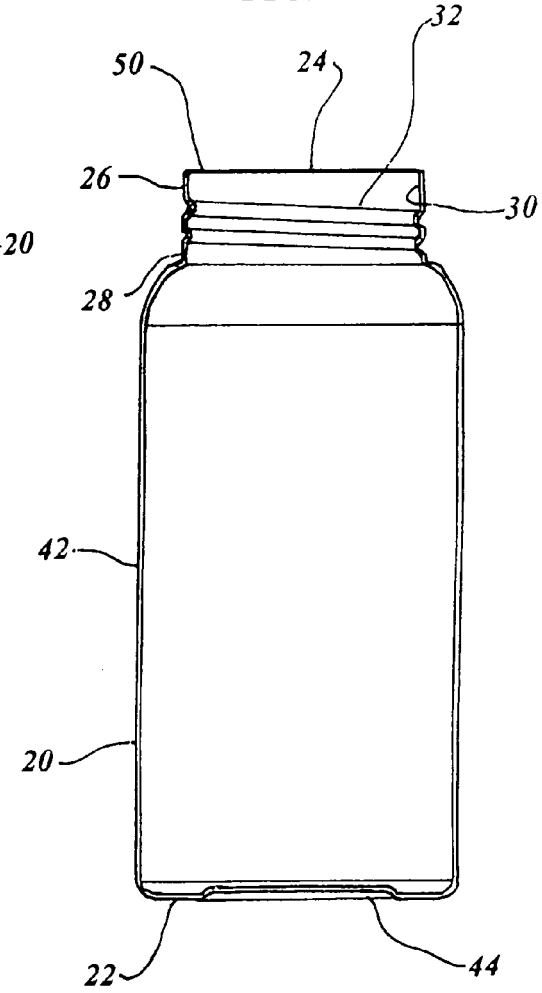
FIG. 6 is a cross sectional view taken along lines 4-4 of FIG. 2 illustrating the bottle with the ferrule removed for clarity.
Figure 8:
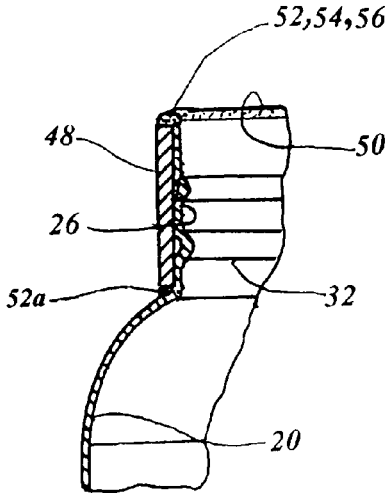
FIG. 8 is a partial cross sectional view of the preferred embodiment taken along an imaginary center line illustrating both the top and bottom weld beads.

The body open top 24 has an integrally formed reduced diameter neck 26, which includes a neck outside surface 28 and a neck inside surface 30. The neck 26 incorporates a number of formed threads 32 protruding inwardly on the neck inside surface 30, as illustrated in FIGS. 4, 6 and 8. The threads 32 are configured to mate with a stopper and/or lid for containing a liquid within the bottle 10 in a sealed liquid tight condition. For aesthetic reasons the bottle body 20 may have an outside diameter that is the same outside diameter as a stopper and/or a lid.

Figure 11:
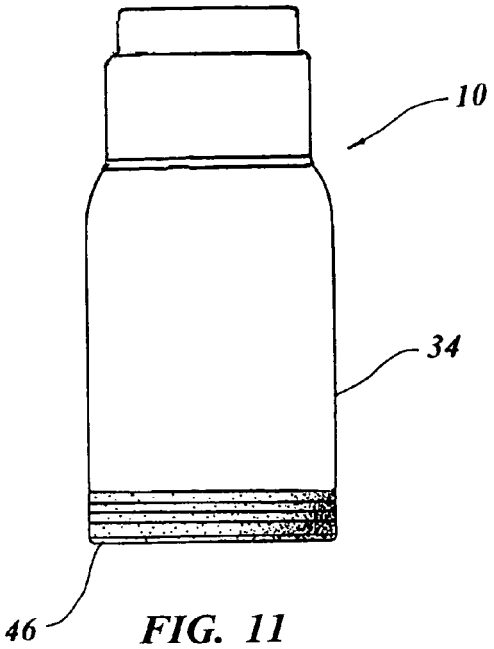
FIG. 11 is a side elevation view of a typical hydration bottle having a slender neck shape.
Figure 12:
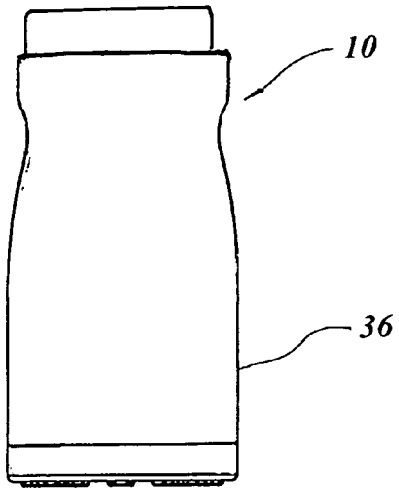
FIG. 12 is a side elevation view of a typical hydration bottle having a slim waist shape.
Figure 13:
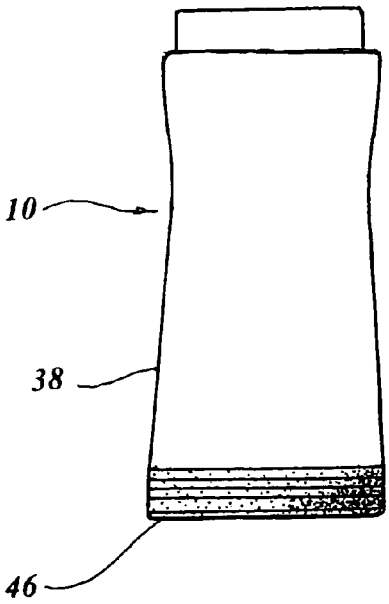
FIG. 13 is a side elevation view of a typical hydration bottle having a tapered waist shape.
Figure 14:
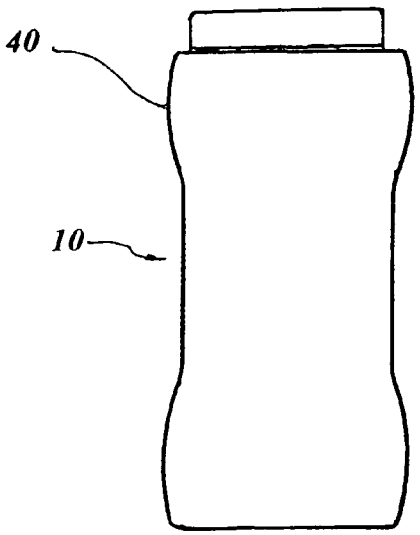
FIG. 14 is a side elevation view of a typical hydration bottle having a dumbbell shape.

The single wall stainless steel cylindrical body 20 is preferably formed from a food grade 18/8 stainless steel material, which by its specific nature, is bisphenol A (BPA)-free. The cylindrical body 20 may have almost any shape and still be within the limits of the claims. It is anticipated that a number of appropriate shapes lend themselves to this application such as a slender neck shape 34 illustrated in FIG. 11, a slim waist shape 36 shown in FIG. 12, a tapered waist shape 38 depicted in FIG. 13 and the dumbbell shape 40 of FIG. 14, however a straight wall shape 42 is preferred, as illustrated in FIGS. 1, 4, 6 and 7. Any finish is acceptable however a viable alternative to the preferred polished or brushed finish on the outside surface of the bottle 10 includes a baked enamel finish of any color. While the bottom 22 of the body 20 is preferably flat with a recessed center section 44 the bottom 22 may incorporate a resilient base 46, as illustrated in FIGS. 11 and 13.

Figure 5:
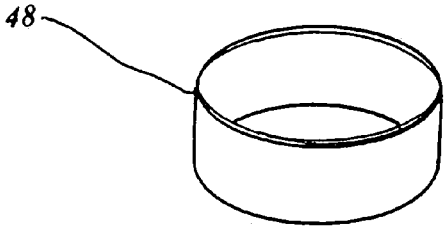
FIG. 5 is a partial isometric view of the stainless steel ferrule in the preferred embodiment.

A stainless steel ferrule 48 is positioned over of the outside surface 28 of the neck 26 and is inserted over the neck of the bottle body 20 and is preferably pressed into place forming an interference fit therebetween. The ferrule 48 is illustrated in position in FIGS. 1-3, 8 and 11-14 and removed alone in FIGS. 5 and 7. The stainless steel ferrule 48 preferably has a thickness greater than the body 20 thickness by at least 2 times which provides a wider strengthened region for the neck 26 at its distal surface 50. It is preferred that the ferrule 48 is seamless and formed from the same grade of stainless steel as the body 20 of the bottle 10 to eliminate any dissimilar metal problems.

A weld bead 52 joins the neck 26 of the bottle 10 to the ferrule 48 at its upper surface 50 forming a homogeneous smooth juncture, permitting liquid to be sipped from the bottle 10 comfortably. This weld bead 52 eliminates any sharp edges and not only forms a homogeneous smooth juncture but also permits a ground surface 54 to be formed at the junction apex excluding any and all irregularities that remain after welding. After grinding, the surface 54 is preferably buffed into a smooth polished finish 56.

A bottom weld bead **52*a* joins the bottom of the ferrule 48 to the bottle body 20 at an interface of the bottle neck 26 to the body 20 forming a homogenous juncture creating a hermetic seal between the ferrule 48 and the bottle body 20 preventing entry of foreign matter between the ferrule 48 and body 20 and eliminating any growth of microorganism's within the microscopic gap therebetween. FIG. 8 depicts both the top weld bead 52 and the bottom weld bead 52***a*.

Figure 7:
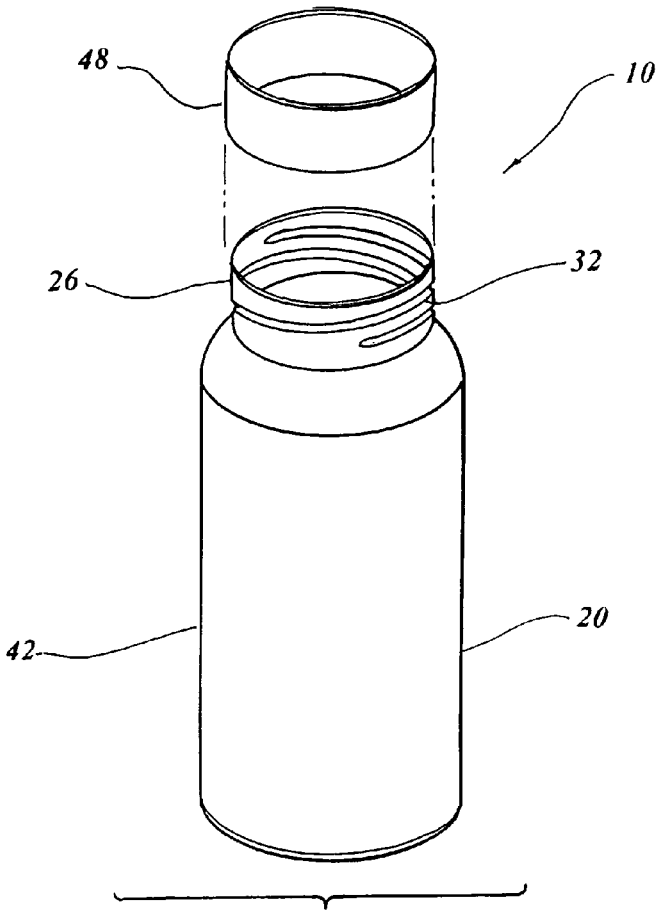
FIG. 7 is an exploded view of the hydration bottle in the preferred embodiment.
Figure 9:
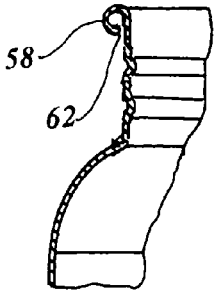
FIG. 9 PRIOR ART
FIG. 9 is a partial cross sectional view, taken along an imaginary center line, of a PRIOR ART bottle having a typical rolled-out lip.
Figure 10:
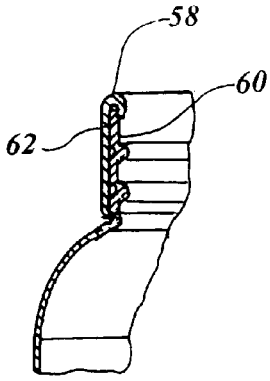
FIG. 10 PRIOR ART
FIG. 10 is a partial cross sectional view, taken along an imaginary center line, of a PRIOR ART bottle having a typical rolled-in lip with an aluminum threaded insert.

FIG. 7 illustrates the hydration bottle 10 in an exploded view and FIG. 8 depicts the interface of the ferrule 48 with the bottle neck 26 in an enlarged section taken on an imaginary center line. FIG. 9 depicts the prior art construction method of forming a lip 58 using a rolled-out form and FIG. 10 shows the prior art method of forming a lip 58 using a rolled-in form of a lip 58 in conjunction with an aluminum threaded insert 60. The gap or space 62 is noted in each prior art embodiment.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A pressed double layer lip hydration bottle which comprises;

a single wall stainless steel cylindrical body having an enclosed bottom, an open top, and a reduced diameter neck, wherein said single wall stainless steel cylindrical body further comprises bisphenol A (BPA)-free, food grade 18/8 stainless steel material, and said body open top having an integrally formed reduced diameter neck, said neck having an outside surface and an inside surface, wherein the bottle cylindrical body has an outside diameter the same as an outside diameter of a threaded lid, said enclosed bottom is flat having a recessed center section, said neck having a plurality of formed threads protruding inwardly on the neck inside surface, said threads configured to mate with a threaded lid for containing liquid within the bottle in a sealed manner, a stainless steel ferrule tightly fitting on top of the outside surface of the neck, with no threads or seams visible from the outside, wherein said stainless steel ferrule further comprises a cylindrical flat band and is tightly fitting on top of the outside surface of the neck, wherein said stainless steel ferrule further has a thickness greater than the body thickness by at least 2 times, said stainless steel ferrule tightly fitting on top of the outside surface of the neck having a pressed interference fit therebetween, and said stainless steel ferrule further comprises bisphenol A (BPA)-free, food grade 18/8 stainless steel material, a top weld bead joining the bottle neck top to the ferrule top upper surface forming a homogeneous smooth juncture with the top weld bead Junction apex having a ground surface eliminating all irregularities and sharp edges, wherein said top weld bead ground surface further comprises a polished finish, and a bottom weld bead joining the bottom of the ferrule to the bottle body at an interface of the bottle neck to the body forming a homogenous juncture creating a hermetic seal between the ferrule and the bottle preventing entry of foreign matter and growth of microorganism's therebetween.

2. The pressed double layer lip hydration bottle as recited in claim 1 wherein said single wall stainless steel cylindrical body further having a shape selected from the group consisting of a straight wall shape, a slender neck shape, a slim waist shape, a tapered waist shape and a dumbbell shape.

3. The pressed double layer lip hydration bottle as recited in claim 1 wherein said single wall stainless steel cylindrical body further comprises a baked enamel finish.

4. The pressed double layer lip hydration bottle as recited in claim 1 wherein said stainless steel ferrule cylindrical flat band further comprises a continuous seamless band of stainless steel covering.

* * * * *